US005480116A

United States Patent [19]

Callas

[11] Patent Number: 5,480,116

[45] Date of Patent: Jan. 2, 1996

[54] SIGN HOLDER

[76] Inventor: Mike T. Callas, 120 Gideons Point Rd., Tonka Bay, Minn. 55331

[21] Appl. No.: 295,433

[22] Filed: Aug. 25, 1994

Related U.S. Application Data

[63] Continuation-in-part of Ser. No. 23,008, May 17, 1994.

[51] Int. Cl.[6] ..... A47B 96/06

[52] U.S. Cl. ..... 248/228.4; 248/317; 248/340

[58] Field of Search ..... 248/317, 340, 248/228, 229, 231.8; 24/260, 522; 52/39

[56] References Cited

U.S. PATENT DOCUMENTS

| | | | |
|---|---|---|---|
| D. 229,452 | 11/1973 | Bentley . | |
| D. 240,709 | 7/1976 | Vandenberg . | |
| D. 283,674 | 5/1986 | Paradis et al. . | |
| D. 289,251 | 4/1987 | Joseph . | |
| D. 321,639 | 11/1991 | Adams . | |
| D. 321,914 | 11/1991 | Tam . | |
| D. 347,449 | 5/1994 | Garfinkle . | |
| D. 350,157 | 8/1994 | Hart . | |
| 1,417,325 | 4/1922 | Hopp . | |
| 1,717,156 | 6/1929 | Johansson . | |
| 2,704,409 | 3/1955 | Randall . | |
| 3,148,856 | 9/1964 | Orlando . | |
| 3,178,138 | 4/1965 | Hessodoerfer et al. . | |
| 3,532,310 | 10/1970 | Finfrock . | |
| 3,743,228 | 7/1973 | Drab | 248/228 |
| 3,936,913 | 2/1976 | Weissman | 248/317 X |
| 3,952,985 | 4/1976 | Davenport | 248/317 |
| 4,112,550 | 9/1978 | DeWitt et al. . | |
| 4,118,000 | 10/1978 | Campbell | 248/340 X |
| 4,135,692 | 1/1979 | Ferguson | 248/228 X |
| 4,223,488 | 9/1980 | Schoenung | 52/39 |
| 4,315,611 | 2/1982 | Hoop | 248/317 X |
| 4,318,525 | 3/1982 | Welch | 248/340 X |
| 4,667,913 | 5/1987 | Peelle | 248/228 |
| 4,677,780 | 7/1987 | Shuman . | |
| 4,776,116 | 10/1988 | Shuman . | |
| 4,776,549 | 11/1988 | Anastos . | |

FOREIGN PATENT DOCUMENTS

| | | |
|---|---|---|
| 1030537 | 5/1958 | Germany . |

*Primary Examiner*—J. Franklin Foss
*Attorney, Agent, or Firm*—Burd, Bartz & Gutenkauf

[57] ABSTRACT

A sign holder assembly is used to pendently support signs, posters and like material from a ceiling or overhead support. The holder assembly has a semi-flexible plastic clip that snaps over a ceiling grid to hang a sign from a ceiling. A hook slides into a groove in the bottom of the clip to lock the clip on the ceiling grid. The lower end of the hook extends through an eyelet in the sign to support the sign.

19 Claims, 2 Drawing Sheets

SIGN HOLDER

CROSS REFERENCE TO RELATED APPLICATION

This Application is a continuation-in-part of U.S. application Ser. No. 29/023,008 filed May 17, 1994.

FIELD OF THE INVENTION

The invention relates holding devices for suspending and hanging sheet material, such as signs, from overhead support structure for display, particularly, holding devices attachable directly to ceiling structures for supporting signs.

BACKGROUND OF THE INVENTION

Hanging of signage in retail stores is cumbersome and time consuming. In the past, the use of sophisticated hardware assemblies and wire was necessary to suspend signs and the like from ceiling strutures. Displacement and gouging of ceiling tiles are common problems with use of these hardware assemblies and wires. This method is not cost effective.

SUMMARY OF THE INVENTION

The invention is directed to a sign holder assembly that is removably attached to a ceiling strip to support a vertically displayed object, such as a sale sign, poster and like advertising material. Installation, repositioning and changing of signs is facilitated with the sign holder assembly resulting in reduced labor costs and customer inconvenience.

A perferred embodiment of the sign holder assembly has at least one clip member that is clipped to a ceiling strip. The clip member has a pair of side walls that have top ends and bottom ends. A transverse wall is connected to the middle portions of each side wall enabling the top ends of the side walls to separate when the bottom ends are moved together. When the bottom ends are pinched together, the top ends separate to release the clip member from the ceiling strip. A hook is slidably mounted on the clip member. The hook has a rectangular-shaped connector that extends into a slot located in the lower end of the clip member adjacent the bottom ends of the side walls to mount the hook on the clip member. When the connector is located in the slot, the connector blocks inward movement of the bottom ends to prevent outward movement of the top ends of the clip side walls and release of the clip member from the strip. The shape of the connector is complimentary to the the shape of the slot. The side walls have inwardly directed lower ends or ears that partially close a bottom portion of the slot to retain the connector within the slot. The hook has an upwardly directed lower end that is accommodated by a hole in the top portion of the sign to hang the sign from the ceiling.

A plurality of clip members can be used to hang a larger sized sign from a ceiling strip. The clip members are moved along the ceiling strip to laterally space the hooks a distance equal to the lateral distance between the holes in the top portion of the sign thereby suspending the sign at a level position relative to the ceiling.

A plurality of hooks can be connected in end-to-end relation to vary the distance between the ceiling and the sign. The connector of each hook has a transverse bore that accommodates the upwardly directed lower end of an adjacent hook to vertically connect the hooks together.

DESCRIPTION OF THE PREFERRED EMBODIMENT

Figure 1:
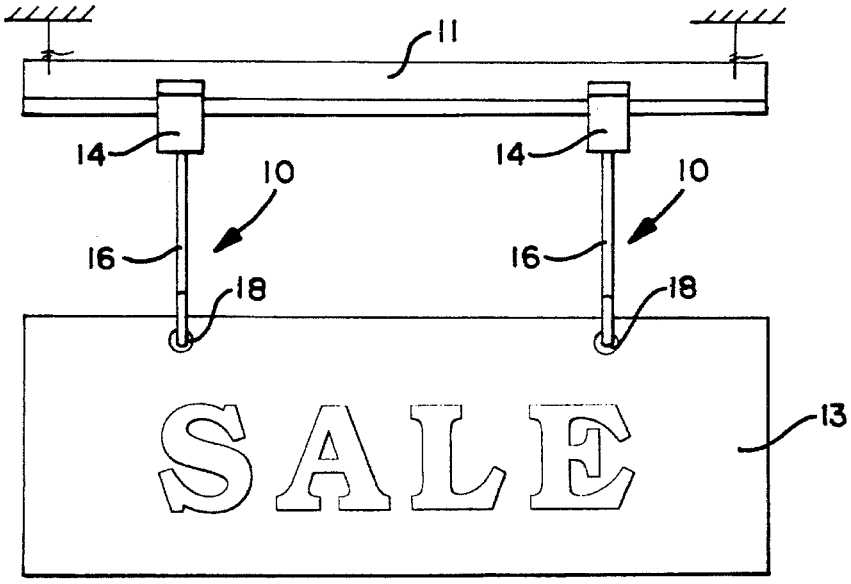
FIG. 1 is a diagrammatic view of a plurality of sign holder assemblies of the invention supporting a sign and clipped on a ceiling strip.

Referring to FIG. 1, there is shown a pair of sign holders of the invention, indicated generally at 10 for supporting a vertical sheet 13, such as a poster, sign or advertisement, for display in a retail store and the like. Holder 10 is adapted to support sheets having custom widths and lengths at various heights. Sign 13 is displayed evenly and professionally with holder 10. Holder 10 is attached to a ceiling surface of a building, such as standard ceiling strips 11 used to accommodate ceiling tiles. Holder 10 can be easily and quickly installed and removed from strip 11 resulting in reduced labor time and hardware costs, and prevents damage to the ceiling structure. This allows the hanging of posters, signs, or advertisements from the ceiling by a single workperson during store hours without inconvenience and disruption of customers.

Referring to FIG. 1, holders 10 are releasably supported on a ceiling strip 11 that is commonly used to carry ceiling tiles or panels. Ceiling strip 11 has a generally T-shaped cross section having a generally flat lower surface with an uniform width. Each holder 10 has a hook 16 having an upwardly extended lower end 17 that is accommodated by an eyelet 18 in the top of a sign 13 to mount the sign on holder 10. Holders 10 can be positioned on ceiling strip 11 so as to laterally space hooks 16 at a distance equal to the lateral distance between eyelets 18 so that sign 13 will be hung at a level position.

Figure 2:
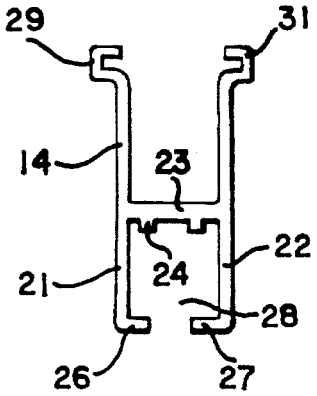
FIG. 2 is an enlarged side elevational view of a clip member of the sign holder assembly of FIG. 1.
Figure 6:
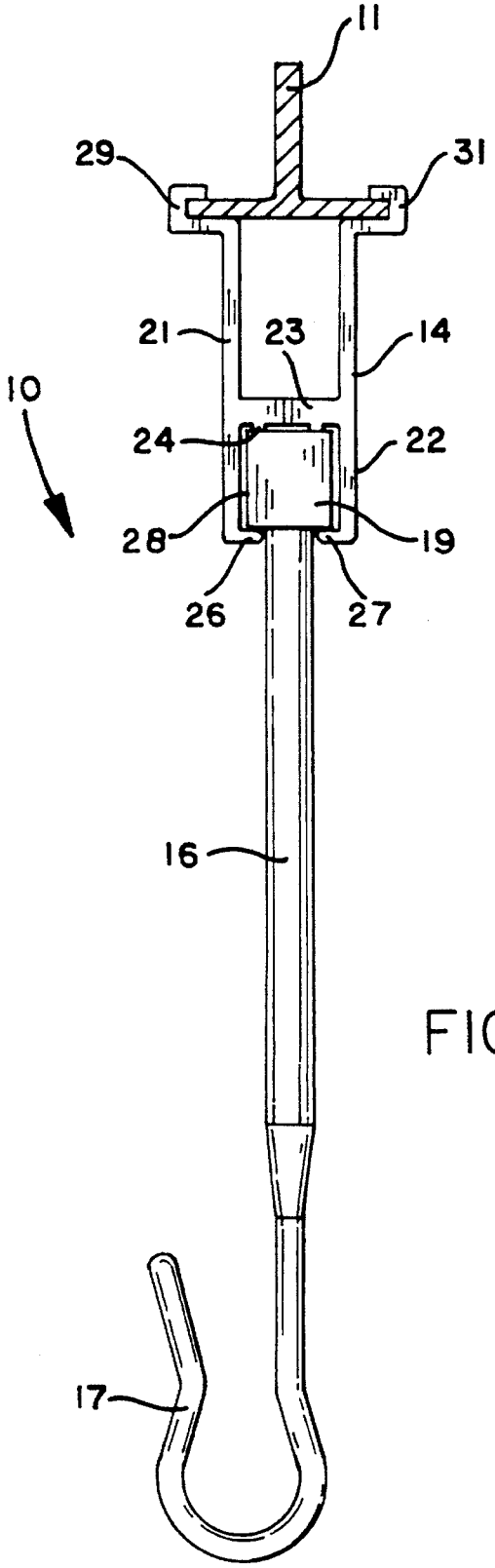
FIG. 6 is an enlarged side elevational view of the sign holder assembly.

Referring to FIGS. 2 to 7, holder 10 has an H-shaped clip member 14 having a pair of laterally spaced side walls 21 and 22 joined together at a middle portion with a transverse wall 23. Clip member 14 is a one-piece structure made of semi-flexible material, such as plastic. The tops of side walls 21 and 22 can be separated by pinching the bottoms of walls 21 and 22 together, as shown by arrows 32 and 33 in FIG. 3, to attach clip member 14 on ceiling strip 11. Transverse wall 23 functions as a fulcrum whereby when the bottoms of side walls 21 and 22 are moved togther the tops of walls 21 and 22 swing apart and separate. When the pinching force is removed from the bottoms of side walls 21 and 22, side walls 21 and 22 return to their original upright positions, as seen in FIG. 2. Clip member 14 is attached to a ceiling strip 11 by forcing the tops of side walls 21 and 22 apart and then moving clip member 14 upwardly, as shown by arrow 34 in FIG. 3, so that channel-shaped ends 29 and 31 extend around the side edges of ceiling strip 11, as seen in FIG. 6. Ends 29 and 31 engage the sides of strip 11 to hold clip member 14 on strip 11.

Clip member 14 has a generally flat transverse wall 23 that extends between side walls 21 and 22 functioning as a live hinge. Walls 21–23 define a horizontal, generally rectangular groove or slot 28 in the bottom portion of clip member 14. Ribs 24 joined to transverse wall 23 extend into slot 28. The bottom of side walls 21 and 22 have inwardly directed flanges or ends 27 and 28 that partially close slot 28. Hook 16 has a cube-shaped slide or connector 19 that is slid into slot 28 to mount hook 16 on clip member 14. Ends 26 and 27 engage the bottom surface of connector 19 and ribs 24 engage the top surface of connector 19 to retain connector 19 in slot 28 in a sliding fit relation. Ends 26 and 27 are laterally spaced from each other to allow connector 19 to be moved into and out of slot 28 with the lower portion of hook 16 extending below clip member 14. When connector 19 is located in slot 28, side walls 21 and 22 cannot be pinched together. This functions to lock the position of channel shaped upper ends 29 and 31 around the side edges of strip 11 so that they cannot be moved outwardly thereby preventing the removal of clip member 14 from ceiling strip 11. The cube shape of connector 19 is complimentary to the rectangular shape of slot 28. The width of connector 19 is slightly less than the width of slot 28 whereby connector 19 has a sliding fit within slot 28 to block inward movement of ends 26 and 27. The lateral space between ends 26 and 27 is less than the width of connector 19 to hold hook 16 on member 14. Connector 19 is placed into slot 28 from either end of slot 28. Connector 19 and slot 28 can have other complimentary shapes.

Figure 7:
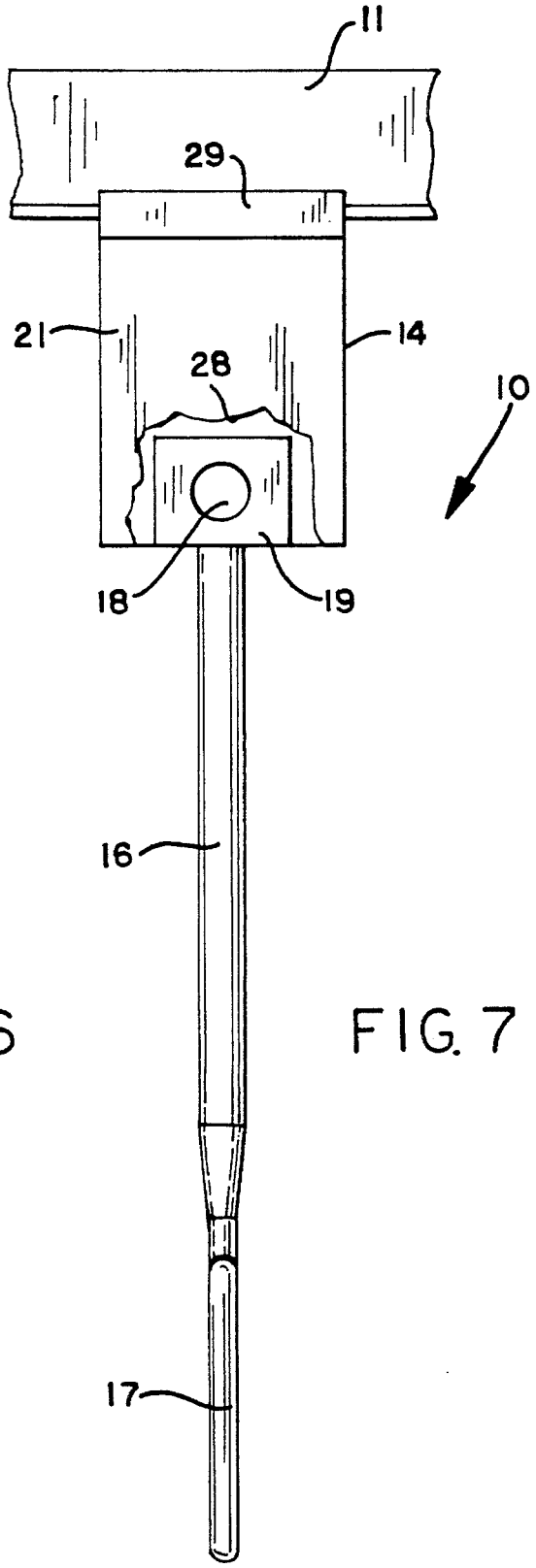
FIG. 7 is an enlarged front elevational view of the sign holder assembly partially sectioned to show the connector of the hook.

A plurality of hooks 16 can be hooked together (not shown) for custom hanging lengths to adjust the vertical position of sign 13 relative to ceiling strip 11. In some installations the height of the ceiling requires the use of a plurality of hooks 16 to postion sign 13 in a location where it can be seen easier. As shown in FIG. 7, connector 19 has a bore 18 for accommodating the lower end portion of an adjacent hook to connect a series of hooks together. Bore 18 extends from a side face of connector 19 to a front face thereof. The lower end of hook 16 extends through bore 18 and projects upwardly therefrom. This prevents hooks 16 from separating from each other when they are hung from clip member 14.

Figure 3:
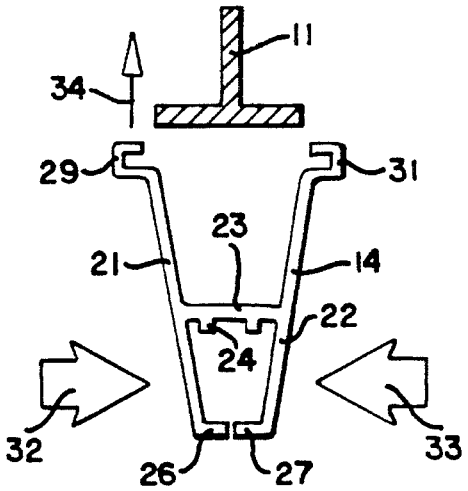
FIG. 3 is an enlarged side elevational view of the clip member being clipped onto the ceiling strip.
Figure 4:
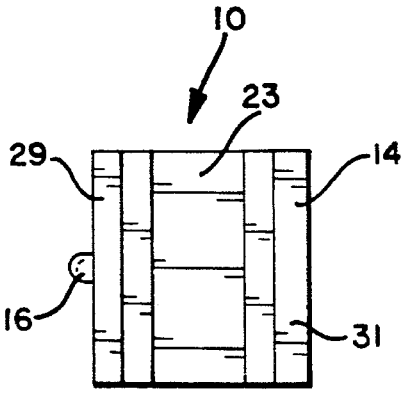
FIG. 4 is an enlarged top view of the sign holder assembly.
Figure 5:
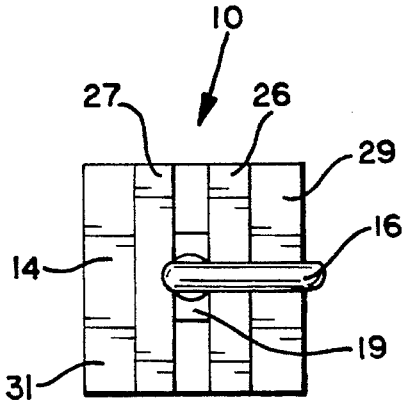
FIG. 5 is an enlarged bottom view of the sign holder assembly.

In use, the lower ends of side walls 21 and 22 are forced or pinched together, as shown by arrows 32 and 33 in FIG. 3, causing the top ends of walls 21 and 22 to pivot outwardly relative to transverse wall 23 thereby separating channel-shaped ends 29 and 31. Clip member 14 is then moved upwardly, as shown by arrow 34, adjacent a ceiling strip 11. The pinching force is released from the lower ends of side walls 21 and 22 allowing the ends 29 and 31 to move inwardly toward their original positions and into engagement with the side edges of ceiling strip 11 to hold clip member 14 on strip 11. A hook 16 is located in slot 28 in the lower portion of clip member 14. Connector 19 of hook 16 is placed in slot 28 from either end thereof. When connector 19 is located in slot 28, top ends 29 and 31 of side walls 21 and 22 cannot be separating thereby locking clip member 14 on ceiling strip 11. Hook 16 is removed from slot 28 so that clip member 14 can be released from ceiling strip 11.

As shown in FIG. 1, a plurality of clip members 14 can be used to support two or more hooks 16 from different lateral postions on ceiling strip 11. Clip members 14 are placed along ceiling strip 11 whereby hooks 16 are laterally spaced at a distance equal to the lateral distance between eyelets 18 of sign 13. Additional hooks can be attached to hooks 16 supported by clip members 14 to vary the vertical distance between the ceiling and sign 13, as desired.

While there has been shown and described a preferred embodiment of the sign holder assembly according to the present invention, it is understood that changes in structure, materials and design can be made by persons skilled in the art without departing from the substance of the invention. The invention is defined in the following claims.

I claim:

1. A device for hanging a sign from a ceiling comprising: at least one member releasably attached to the ceiling, the member having a first wall, a second wall laterally spaced from the first wall, each wall having a top end and a bottom end, the top ends moveable in outward directions to release the member from the ceiling, a transverse wall connected to middle portions of the first and second walls, the top ends pivoting outwardly relative to the transverse wall and separating to release the member from the ceiling, and hanger means mounted on the member and attached to the sign to hang the sign from the ceiling.

2. The device of claim 1 wherein: the hanger means blocks outward movement of the top ends to prevent release of the member from the ceiling.

3. The device of claim 1 wherein: the member has a slot adjacent the bottom ends, the hanger means extending into the slot thereby preventing outward movement of the top ends and release of the member from the ceiling.

4. The device of claim 3 wherein: each bottom end has an inwardly directed flange partially closing a bottom portion of the slot to retain the hanger means in the slot.

5. The device of claim 1 wherein: the member has a slot adjacent the bottom ends, the hanger means comprising a hook having a first end and a second end, the first end extending into the slot thereby blocking outward movement of the top ends and preventing release of the member from the ceiling.

6. The device of claim 5 wherein: the first end has a sliding fit relation with the slot.

7. The device of claim 1 wherein: the hanger means comprises a first hook having a first end and a second end, the first end having a bore adapted to accommodate a second hook to vertically link the hooks together.

8. A device for hanging a sign from a ceiling strip comprising: at least one member releasably attached to the strip, the member having a first wall, a second wall laterally spaced from the first wall, each wall having a top end and a bottom end, the top ends moveable in outward directions to release the member from the strip, the bottom ends moveable in inward directions causing the tops ends to separate, means connnected to the first and second walls enabling the top ends to separate when the bottom ends are moved together, and hanger means mounted on the member and attached to the sign to hang the sign from the strip, the member having a slot adjacent the bottom ends, the hanger means extending into the slot thereby blocking inward movement of the bottom ends to prevent outward movement of the top ends and release of the member from the strip.

9. The device of claim 8 wherein: each bottom end has an inwardly directed flange partially closing a bottom portion of the slot to retain the hanger means in the slot.

10. The device of claim 8 wherein: the hanger means comprises a hook having a first end and a second end, the first end extending into the slot thereby blocking inward movement of the bottom ends to prevent outward movement of the top ends and release of the member from the strip.

11. The device of claim 10 wherein: the first end has a sliding fit relation with the slot, the first end having a width slightly less than a width of the slot.

12. The device of claim 10 wherein: each hook has a first end and a second end, the first end having a bore adapted to accommodate the second end of an adjacent hook to link the hooks together.

13. A device for hanging a sign from a ceiling strip comprising: clip means releasably attached to the strip, the clip means including a plurality of members laterally spaced along the strip, each member having a first wall, a second wall laterally spaced from the first wall, each wall having a top end and a bottom end, the top ends moveable in outward directions to release the member from the strip, the bottom ends moveable in inward directions causing the top ends to separate, means connected to the first and second walls enabling the top ends to separate when the bottom ends are moved together, and hanger means mounted on the member and attached to the sign to hang the sign from the strip, the hanger means blocking inward movement of the bottom ends to prevent outward movement of the top ends and release of the member from the strip.

14. The device of claim 13 wherein: the member has a slot adjacent the bottom ends, the hanger means extending into the slot thereby blocking inward movement of the bottom ends of the first and second walls.

15. The device of claim 14 wherein: each bottom end has an inwardly directed flange partially closing a bottom portion of the slot to retain the hanger means in the slot.

16. The device of claim 13 wherein: the member has a slot adjacent the bottom ends, the hanger means comprising a hook having a first end and a second end, the first end extending into the slot thereby blocking inward movement of the bottom ends to prevent outward movement of the top ends and release of the member from the strip.

17. The device of claim 16 wherein: the first end has a shape complimentary to the slot defined by the first and second walls.

18. The device of claim 13 wherein: each top end includes means located in engagement with the strip to hold the member on the strip.

19. The device of claim 13 wherein: the means connected to the first and second walls is a transverse wall connected to middle portions of each wall.

* * * * *